United States Patent [19]

Bonnes

[11] 4,149,744

[45] Apr. 17, 1979

[54] SNOW SHOVEL

[75] Inventor: David R. Bonnes, Columbus, Ohio

[73] Assignee: The Union Fork & Hoe Company, Columbus, Ohio

[21] Appl. No.: 902,260

[22] Filed: May 2, 1978

[51] Int. Cl.[2] ..... E01H 5/02

[52] U.S. Cl. ..... 294/54

[58] Field of Search ..... 294/54, 55, 49, 51, 294/52, 57; 37/53, 162

[56] References Cited

U.S. PATENT DOCUMENTS

| | | | |
|---|---|---|---|
| 1,517,341 | 12/1924 | Bulger | 294/54 |
| 3,136,574 | 6/1964 | Pasquale | 294/54 |
| 3,177,026 | 4/1965 | Cowan | 294/54 |
| 3,477,149 | 11/1969 | Wagner | 294/54 |

*Primary Examiner*—James B. Marbert

*Attorney, Agent, or Firm*—William V. Miller

[57] ABSTRACT

A snow shovel including a handle and a one-piece plastic scoop so formed of a minimum amount of material as to resist wear and breakage effectively. It has a self-sharpening reinforcing leading edge, a reinforcing flange at the remainder of its peripheral edge, a series of laterally-spaced reinforcing ribs extending from the leading edge rearwardly, and a centrally-disposed reinforcing keel or rib on its back surface extending from the leading edge to its handle-receiving socket. It also has crush ribs in the socket to allow the handle dimensional variations, prevent rotation of the scoop on the handle, and maintain a snug fit.

4 Claims, 6 Drawing Figures

FIG. 2
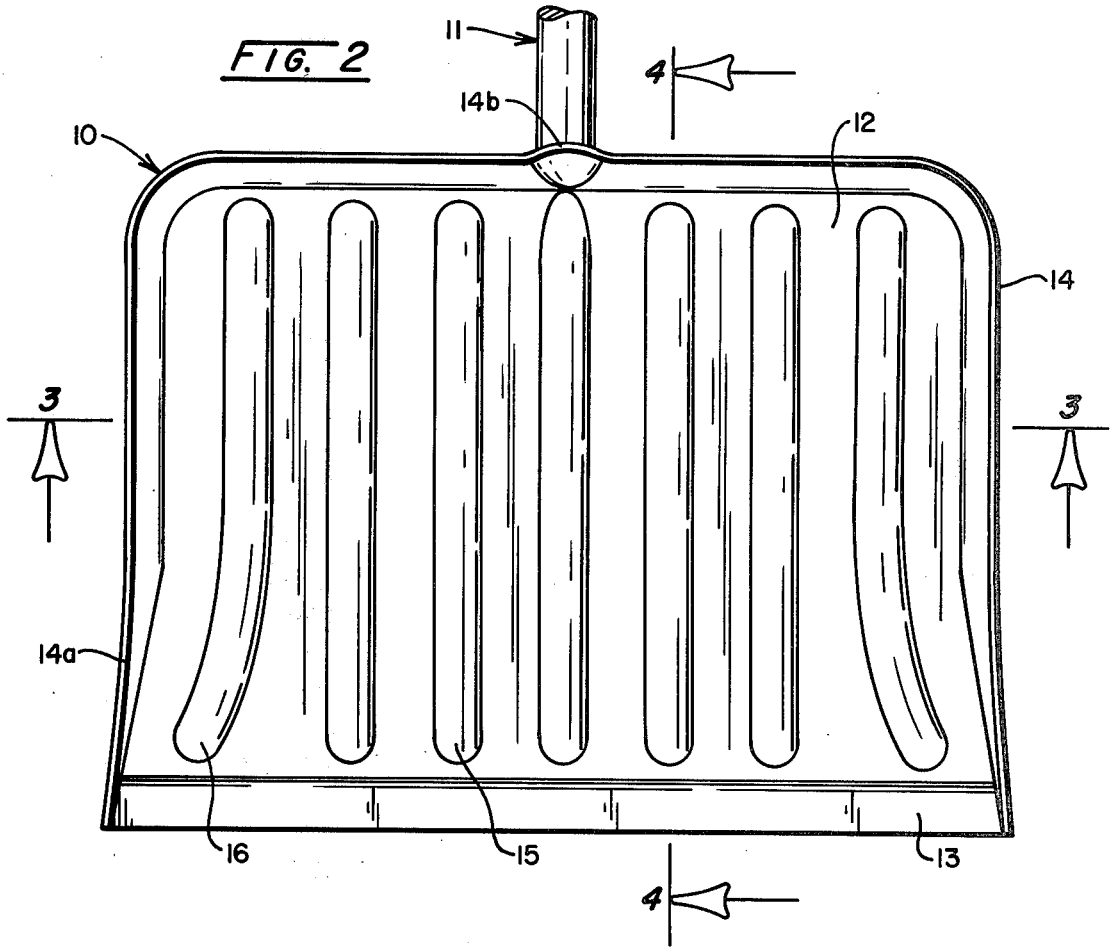
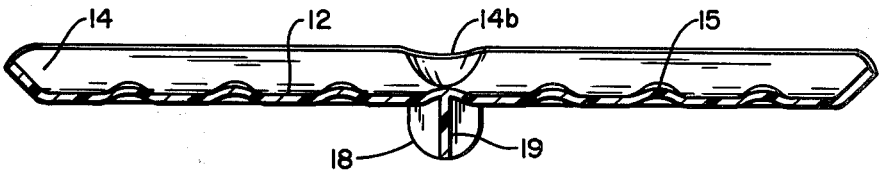
FIG. 3
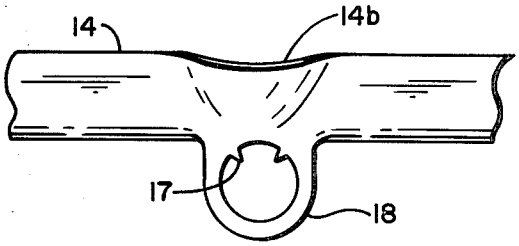
FIG. 6

SNOW SHOVEL

BACKGROUND OF THE INVENTION

Various hand snow shovels are now made with scoops formed of plastic material. The most difficulty encountered with these shovels is the tendency for the scoops to bend and sometimes crack at the leading edge and in the body of the scoop just ahead of the handle-receiving socket. These difficulties prevent uniform snow removal over the full width of the shovel and also limit the shovel width. To attempt to overcome these tendencies it has been necessary to form the scoops of heavy material, thereby increasing their costs, and these attempts have not always been successful.

SUMMARY OF THE INVENTION

The present invention relates to a hand snow shovel which has a scoop of special form and a handle which may be of any suitable type. The scoop is molded in one piece from a suitable plastic, such as high-density polyethylene. A minimum wall thickness of material can be used because of the special reinforcing formation of the scoop. This formation includes a relatively heavy reinforcing and wear rib extending completely across the leading edge of the scoop. This rib, though relatively heavy, has a sharp edge and is formed and arranged that the edge is maintained as the rib does wear back from use. The reinforcing formation also includes a deep snow-retaining flange which extends around the remainder of the peripheral edge of the scoop, and laterally-spaced reinforcing ribs extending rearwardly from the leading edge. In addition, the top of the reinforcing formation contains a molded recess to allow nesting of additional sockets and handles and provide an extremely compact package for shipping when fully assembled. An outwardly-opening handle-receiving socket, with internally molded crush ribs is formed on the back surface of the scoop, at its centerline, and a reinforcing keel or rib is formed which extends from the socket to the reinforcing rib at the leading edge.

BRIEF DESCRIPTION OF THE DRAWINGS

The best mode contemplated for carrying out this invention is illustrated in the accompanying drawings in which:

FIG. 2 is a face view of the scoop of the shovel;

FIG. 3 is a section taken along line 3—3 of FIG. 2;

FIG. 6 is a view of the open end of the socket showing the crush ribs.

DETAILED DESCRIPTION OF THE INVENTION

Figure 1:
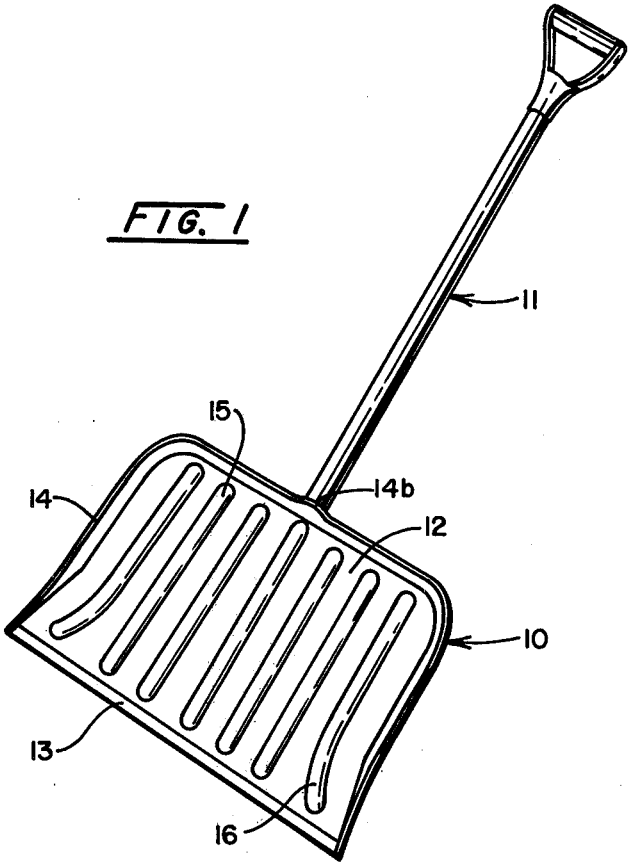
FIG. 1 is a perspective view of the snow shovel of this invention.

With specific reference to the drawings, there is shown in FIG. 1 a hand snow shovel which consists of a scoop and scraper 10 formed according to this invention and a handle 11 of any suitable type.

As indicated before, the scoop 10 is molded in one piece of a high-density plastic of suitable type, such as polyethylene. It is so formed that its wall thickness can be a minimum to save material and it still will have adequate strength to resist the forces encountered in shovelling or scooping snow and ice.

To accomplish this, the body 12 of the scoop is molded to a suitable shape, as indicated, which is of substantially rectangular outline and has a slightly concaved face. It has the leading wear edge or rib 13 and a retaining and reinforcing flange 14 provided at its remaining edges so that it is arranged in U-form.

Figure 4:
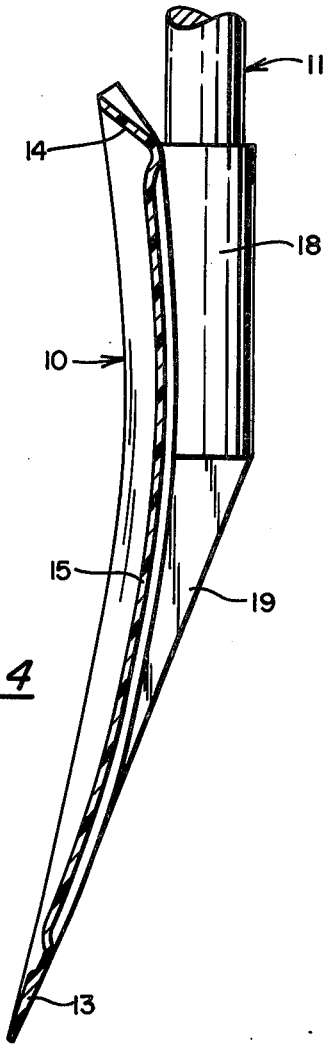
FIG. 4 is an enlarged section taken along lines 4—4 of FIG. 2.
Figure 5:
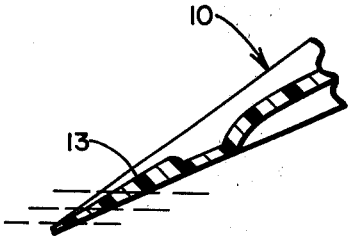
FIG. 5 is a schematic view showing the self-sharpening action of the wear rib.

The formation of the edge or rib 13 is important to this invention not only to resist wear but also as a reinforcement extending the full width of the body 12 to minimize transverse flexing and to prevent cracking of the edge. This wear and reinforcing rib 13 is indicated best in FIGS. 4 and 5, is wedge-shape in cross-section with its sharper edge leading or forward. As the edge wears, as indicated in FIG. 5, it will sharpen itself. It will continue to serve as a reinforcement until it completely wears off.

The flange 14 extending around the other three edges in an U arrangement not only serves to retain a substantial amount of snow on the scoop 10 but also serves as an important reinforcement of the scoop. It is angled outwardly so it will be self-cleaning and is of substantial depth at the rear or trailing edge of the scoop, but its sides gradually decrease in depth at forward portions **14*a* until it substantially merges with the rib 13. The rear part of flange 14 is provided with a mid-portion 14*b* which is curved farther rearwardly to provide for nesting and compact packaging by receiving the adjacent end of the socket of a superimposed scoop. In addition, the scoop body is provided with a series of laterally-spaced reinforcing ribs 15 which are embossed outwardly from its face. All of these ribs are similar except that the end ones have laterally outwardly curved ends 16 toward the adjacent portions 14*a* of flange 14, and the middle one extends more closely to the rear of inner part of flange 14**.

A rearwardly or outwardly opening socket is integrally formed on the back surface of the scoop body 12, adjacent the rear portion of the flange 14, as shown best in FIG. 4, and at the center line laterally thereof. Its outer end is adjacent to the outwardly curved part **14*b* of the flange 14. This socket will receive the handle 11 which is secured therein by crush rib 17 shown in FIG. 6. This handle, may be wood or plastic and when wood, the ribs 17 will deform the wooden handle and will themselves also crush so as to cause an intimate fit. Two ribs 17 are shown in FIG. 6** but more may be used and they may be angularly disposed in the socket in different arrangements than that shown.

To prevent cracking or breakage in the body 12 at the inner end of the socket 18, which is a point of great stress during shovelling or scraping, a reinforcing keel 19 is provided in the form of a rib which projects from the rear surface of the scoop body as shown in FIGS. 3 and 4. This rib is formed at the centerline of the scoop body, midway of its side edges, and is integral with the center rib of the reinforcing ribs 15. It joins the closed end of the socket 18 where it projects rearwardly to substantially the same extent as the socket and is at a right angle to the rib 13. However, it tapers inwardly as it extends toward the rib 13, at the leading edge, and merges with the rib.

It will be apparent that when the scoop is used, the leading edge will be prevented from warping or cracking by the wear and reinforcing rib provided thereon. As this rib wears, it will be self-sharpening and will be a reinforcement until it completely wears away. The outwardly projecting peripheral U-flange will also serve as a reinforcement and will be self-cleaning. The ribs embossed in the face of the scoop will serve as additional reinforcement. The central keel on the back of the scoop will prevent cracking at the inner end of the socket. All of these reinforcement elements will make it possible to use a minimum of material with a resulting lowering of cost with improved strength.

The crush ribs will deform the wooden handle upon assembly and will themselves also crush so as to cause an intimate fit, preventing scoop or head rotation and maintaining the head to the handle.

Having thus described this invention what is claimed is:

1. A snow shovel scoop comprising a body of one-piece plastic having a transversely-extending leading edge for engaging and scraping a surface, said edge having a reinforcing and wear rib extending therealong, said rib being of wedge-shaped crosssection with its sharper edge leading so that, as it wears, it will be self-sharpening and will continue to reinforce the scoop edge until it completely wears away, said body having a face for engaging the snow and an opposed back surface, a handle-receiving socket formed on said back surface at the centerline laterally of said body and spaced from said reinforcing and wear rib on said leading edge, and a reinforcing keel rib projecting from said back surface and extending from said socket to said reinforcing and wear rib, said socket being of tubular form with its axis aligning with said centerline, said socket extending from a rear edge of said scoop body inwardly toward said leading edge of the body and having a closer inner end joining said keel rib, said keel rib extending from said inner socket end to said reinforcing and wear rib and tapering inwardly relatively to said back surface until it merges with said rib, laterally-spaced reinforcing ribs embossed in the face of said body and extending from a point adjacent said reinforcing and wear rib to a point adjacent a rear edge of said body, a retaining and reinforcing flange extending along the periphery of said body except at said leading edge and projecting from said face, said body being of substantially rectangular outline, said laterally spaced ribs including a central rib along said centerline and said keel rib being formed on the back surface of said rib, said leading edge of the scoop body being straight and the keel rib being dispoed at a right angle thereto, and said reinforcing flange extending angularly outwardly relative to the scoop body face along a rear edge and opposed side edges.

2. A snow shovel scoop according to claim 1 in which the flange along the rear edge of the body is provided with a curved position at the handle-receiving socket to facilitate nesting.

3. A snow shovel scoop according to claim 2 in which the socket is of tubular form and has an open end for receiving a handle, said socket having inwardly projecting crush ribs formed therein at angular positions within the tubular socket.

4. A snow shovel scoop comprising a body of one-piece plastic having a transversely-extending leading edge for engaging and scraping a surface, said edge having a reinforing and wear rib extending therealong, said rib being of wedge-shape cross-section with its sharper edge leading so that, as it wears, it will be self-sharpening and will continue to reinforce the scoop edge until it completely wears away, said body having a face for engaging the snow and an opposed back surface, a handle-receiving socket projecting from said back surface at the centerline laterally of said body and spaced from said reinforcing and wear rib on said leading edge, and a reinforcing keel rib projecting from said back surface, said socket being of tubular form with its axis aligning with said centerline, said socket extending from a rear edge of said scoop body inwardly toward said leading edge of the body and having an inner end joining said keel rib, said keel rib extending from said inner socket end to a point adjacent said leading edge and tapering inwardly relatively to said back surface until it merges therewith, laterally-spaced reinforcing ribs formed in said body and extending from a point adjacent said reinforcing and wear rib to a point adjacent a rear edge of said body, a retaining and reinforcing flange extending along the periphery of said body except at said leading edge and projecting outwardly from said face, said laterally spaced ribs including a central rib along said centerline and said keel rib being joined to said central rib, said leading edge of the scoop body being straight and the keel rib being disposed at a right angle thereto.

* * * * *

UNITED STATES PATENT OFFICE

CERTIFICATE OF CORRECTION

Patent No. 4,149,744 Dated April 17, 1979

Inventor(s) David R. Bonnes

It is certified that error appears in the above-identified patent and that said Letters Patent are hereby corrected as shown below:

Column 4: line 7, change "position" to ------ portion---.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*